US012618015B2

(12) United States Patent
Van Hasselt et al.

(10) Patent No.: US 12,618,015 B2
(45) Date of Patent: May 5, 2026

(54) PROCESS FOR PRODUCING KEROSENE FROM RENEWABLE SOURCES

(71) Applicant: SHELL USA, INC., Houston, TX (US)

(72) Inventors: Bastiaan Willem Van Hasselt, Amsterdam (NL); Roy Léon Bernard Henket, Amsterdam (NL); Marjan Samson, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 137 days.

(21) Appl. No.: 18/683,263

(22) PCT Filed: Sep. 14, 2022

(86) PCT No.: PCT/US2022/043465
§ 371 (c)(1),
(2) Date: Feb. 13, 2024

(87) PCT Pub. No.: WO2023/043796
PCT Pub. Date: Mar. 23, 2023

(65) Prior Publication Data

US 2025/0136878 A1 May 1, 2025

Related U.S. Application Data

(60) Provisional application No. 63/245,017, filed on Sep. 16, 2021.

(30) Foreign Application Priority Data

Sep. 28, 2021 (EP) ..... 21199562

(51) Int. Cl.
*C10G 67/14* (2006.01)

(52) U.S. Cl.
CPC ..... *C10G 67/14* (2013.01); *C10G 2300/1003* (2013.01); *C10G 2300/1011* (2013.01); *C10G 2400/08* (2013.01)

(58) Field of Classification Search
CPC ..... Y02P 30/20; C10G 3/50; C10G 67/14; C10G 7/00; C10G 2300/1003; C10G 2300/1011; C10G 2400/08
See application file for complete search history.

(56) References Cited

U.S. PATENT DOCUMENTS 8,193,400 B2 6/2012 Brady et al.
8,198,492 B2 6/2012 Brady et al.
(Continued)

FOREIGN PATENT DOCUMENTS

EP 3696250 A1 8/2020

OTHER PUBLICATIONS

Office Action Received for Australian Application No. 2022346777, Mailed on Mar. 6, 2025, 03 Pages(03 Pages of Official Copy).
(Continued)

*Primary Examiner* — Vishal V Vasisth
(74) *Attorney, Agent, or Firm* — SHELL USA, INC.

(57) ABSTRACT

A process for producing kerosene involves reacting a renewable feedstock in a hydroprocessing section under hydroprocessing conditions sufficient to cause a hydroprocessing reaction to produce a hydroprocessed effluent. The hydroprocessed effluent is separated to produce a hydroprocessed liquid stream and a separation system offgas stream. The hydroprocessed liquid stream is directed to a work-up section where gases are stripped to produce a stripped liquid product stream and a stripper offgas stream. A gas stream comprising the separation system offgas stream and/or the stripper offgas stream are directed to a gas-handling section to obtain a pressurized gas stream and a hydrocarbon fraction that is liquid at a pressure in a range from 0-1.5 MPaG and a temperature in a range from 0 to 50 C. The hydrocarbon fraction is recycled to the work-up section. A
(Continued)

kerosene stream separated in the product recovery unit has a higher yield compared to conventional processes.

12 Claims, 8 Drawing Sheets

(56) References Cited

U.S. PATENT DOCUMENTS

| | | | | |
|---|---|---|---|---|
| 8,314,274 | B2 | 11/2012 | Marker et al. | |
| 8,742,183 | B2 | 6/2014 | McCall et al. | |
| 8,912,374 | B2 | 12/2014 | Van Heuzen et al. | |
| 11,021,666 | B2 | 6/2021 | Ginestra et al. | |
| 2009/0229173 | A1 | 9/2009 | Gosling | |
| 2015/0240169 | A1 | 8/2015 | Ladkat et al. | |
| 2018/0171246 | A1 | 6/2018 | Pupat et al. | |
| 2018/0216010 | A1* | 8/2018 | Hong | C10G 7/00 |

OTHER PUBLICATIONS

International Search Report and Written Opinion received for PCT Patent Application No. PCT/US2022/043465, mailed on Oct. 27, 2022, 7 Pages.

* cited by examiner

PROCESS FOR PRODUCING KEROSENE FROM RENEWABLE SOURCES

CROSS REFERENCE TO RELATED APPLICATIONS

This is a National stage application of International Application No. PCT/US2022/043465, filed 14 Sep. 2022, which claims priority of U.S. Provisional Application No. 63/245,017 filed 16 Sep. 2021 and European Application No. 21199562.6 filed 28 Sep. 2021 which is incorporated herein by reference in its entirety.

FIELD OF THE INVENTION

The present invention relates to the field of producing kerosene from renewable sources and, in particular, to a process for improving the yield of kerosene from renewable sources.

BACKGROUND OF THE INVENTION

The increased demand for energy resulting from worldwide economic growth and development has contributed to an increase in concentration of greenhouse gases in the atmosphere. This has been regarded as one of the most important challenges facing mankind in the 21st century. To mitigate the effects of greenhouse gases, efforts have been made to reduce the global carbon footprint. The capacity of the earth's system to absorb greenhouse gas emissions is already exhausted. Accordingly, there is a target to reach net-zero emissions by 2050. To realize these reductions, the world is transitioning away from solely conventional carbon-based fossil fuel energy carriers. A timely implementation of the energy transition requires multiple approaches in parallel. For example, energy conservation, improvements in energy efficiency and electrification may play a role, but also efforts to use renewable resources for the production of fuels and fuel components and/or chemical feedstocks.

Typical jet fuels and liquid kerosene rocket fuels are prepared in a refinery from a crude mineral oil source. Typically, the crude mineral oil is separated by means of distillation into a distillate kerosene fraction boiling in the aviation fuel range or a more purified liquid kerosene rocket fuel. If required, these fractions are subjected to hydroprocessing to reduce sulfur, oxygen, and nitrogen levels. For the reasons mentioned above, there is a need to explore methods to increase environmentally-friendly fuel sources while meeting jet fuel specifications.

Vegetable oils, oils obtained from algae, and animal fats are seen as new sources for low carbon fuel production. Also, deconstructed materials are seen as a potential source for low carbon renewable fuels materials, such as pyrolyzed recyclable materials or wood. Renewable materials may comprise materials such as triglycerides with very high molecular mass and high viscosity, which means that using them directly or as a mixture in fuel bases is problematic for modern engines. On the other hand, the hydrocarbon chains that constitute, for example, triglycerides are essentially linear and their length (in terms of number of carbon atoms) is compatible with the hydrocarbons used in/as fuels. Thus, it is attractive to transform triglyceride-comprising feeds in order to obtain good quality fuel components. As well, renewable feedstocks may comprise unsaturated compounds and/or oxygenates that are unsaturated compounds.

Petroleum-derived jet fuels inherently contain both paraffinic and aromatic hydrocarbons. In general, paraffinic hydrocarbons offer the most desirable combustion cleanliness characteristics for jet fuels. Challenges in using paraffinic hydrocarbons from renewable sources include higher boiling point, due to chain length, and higher freeze point. Solutions to these challenges include cracking to reduce chain length and/or isomerization to increase branching to reduce the freeze-point. Aromatics generally have the least desirable combustion characteristics for aircraft turbine fuel. In aircraft turbines, certain aromatics, such as naphthalenes, tend to burn with a smokier flame and release a greater proportion of their chemical energy as undesirable thermal radiation than other more saturated hydrocarbons.

The closest current option for reducing aviation emissions is blending synthesized paraffinic kerosene ("SPK") from Fischer-Tropsch or hydroprocessed esters and fatty acids with conventional jet fuel. Up to 50% by volume of SPK is permitted by the alternative jet fuel specification ASTM D7566. If the resulting blend meets the specification, it can be certified and considered equivalent to conventional, petroleum-derived jet fuel. Typically, these synthesized paraffinic kerosenes contain a mixture of normal and branched paraffin according to ASTM D7566.

Ginestra et al. (U.S. Pat. No. 11,021,666, 1 Jun. 2021) is directed to a method for upgrading a kerosene fuel to meet Jet A-1 or JP-8 specifications by blending a kerosene base fuel with a synthetic cyclo-paraffinic kerosene fuel.

Brady et al. (U.S. Pat. No. 8,193,400, 5 Jun. 2012) relates to a process for producing a branched-paraffin-enriched diesel product by hydrogenating/hydrodeoxygenating a renewable feedstock, separating a gaseous stream comprising $H_2$, $H_2O$ and carbon oxides from n-paraffins in a hot high-pressure hydrogen stripper, and isomerizing the n-paraffins to generate a branched paraffin-enriched stream. The paraffin-enriched stream is cooled and separated into (i) an LPG and naphtha stream and (ii) a diesel boiling range stream. A portion of stream (i), (ii) or separated LPG and/or naphtha from stream (i) is recycled to the rectification zone of the hot high-pressure stripper to increase the hydrogen solubility of the reaction mixture. The effluent from the hot high-pressure stripper is then isomerized.

Similarly, Brady et al. (U.S. Pat. No. 8,198,492, 12 Jun. 2012) relates to a process for producing diesel and aviation boiling point products by hydrogenating/hydrodeoxygenating a renewable feedstock and separating a gaseous stream comprising $H_2$, $H_2O$ and carbon oxides from n-paraffins in a hot high-pressure hydrogen stripper. The n-paraffins are isomerized and selectively cracked to generate a branched paraffin-enriched stream. The paraffin-enriched stream is cooled and separated into an overhead stream, a diesel boiling point range product and an aviation boiling point range product. A portion of the diesel boiling point range product, the aviation boiling point range product, naphtha product, and/or LPG is recycled to the rectification zone of the hot high-pressure stripper to decrease the amount of product carried in the stripper overhead. The effluent from the hot high-pressure stripper is then isomerized.

In Marker et al. (U.S. Pat. No. 8,314,274, 20 Nov. 2012), a renewable feedstock is hydrogenated/hydrodeoxygenated and then isomerized and selectively hydrocracked to generate an effluent comprising branched paraffins. The effluent is separated to provide an overhead stream, an optional aviation product stream, a diesel stream and a stream having higher boiling points. A portion of the diesel boiling point range product is recycled to the isomerization and selective hydrocracking zone.

McCall et al. (U.S. Pat. No. 8,742,183, 3 Jun. 2014) describes a process for producing aviation fuel from a renewable feedstock by hydrogenating/hydrodeoxygenating, then concurrently isomerizing and selectively cracking. Paraffins having eight or less carbon atoms from the deoxygenation, isomerization and cracking zones are directed, along with steam, to a reforming zone to produce hydrogen for recycle to any of the reaction zones.

There remains a need for improving the yield of kerosene from renewable sources.

SUMMARY OF THE INVENTION

According to one aspect of the present invention, there is provided a process for producing kerosene from a renewable feedstock, the process comprising the steps of: reacting a renewable feedstock in a hydroprocessing section under hydroprocessing conditions sufficient to cause a hydroprocessing reaction to produce a hydroprocessed effluent; separating the hydroprocessed effluent to produce at least one hydroprocessed liquid stream and at least one separation system offgas stream; directing one or more of the at least one hydroprocessed liquid stream to a work-up section, comprising a product stripper and a product recovery unit; stripping one or more of the at least one hydroprocessed liquid stream in the product stripper to remove gases from the one or more of the at least one hydroprocessed liquid stream to produce a stripped liquid product stream and a stripper offgas stream; directing a gas stream comprising gases selected from the group consisting of one or more of the at least one separation system offgas stream, the stripper offgas stream, and combinations thereof, to a gas-handling section to obtain a pressurized gas stream and a hydrocarbon fraction that is liquid at a pressure in a range from 0.5 to 15 barg (0-1.5 MPaG) and a temperature in a range from 0 to 50° C.; recycling the hydrocarbon fraction to the work-up section; and separating a kerosene stream from the stripped liquid product stream in the product recovery unit.

BRIEF DESCRIPTION OF THE DRAWINGS

The process of the present invention will be better understood by referring to the following detailed description of preferred embodiments and the drawings referenced therein, in which.

DETAILED DESCRIPTION OF THE INVENTION

Figure 1:
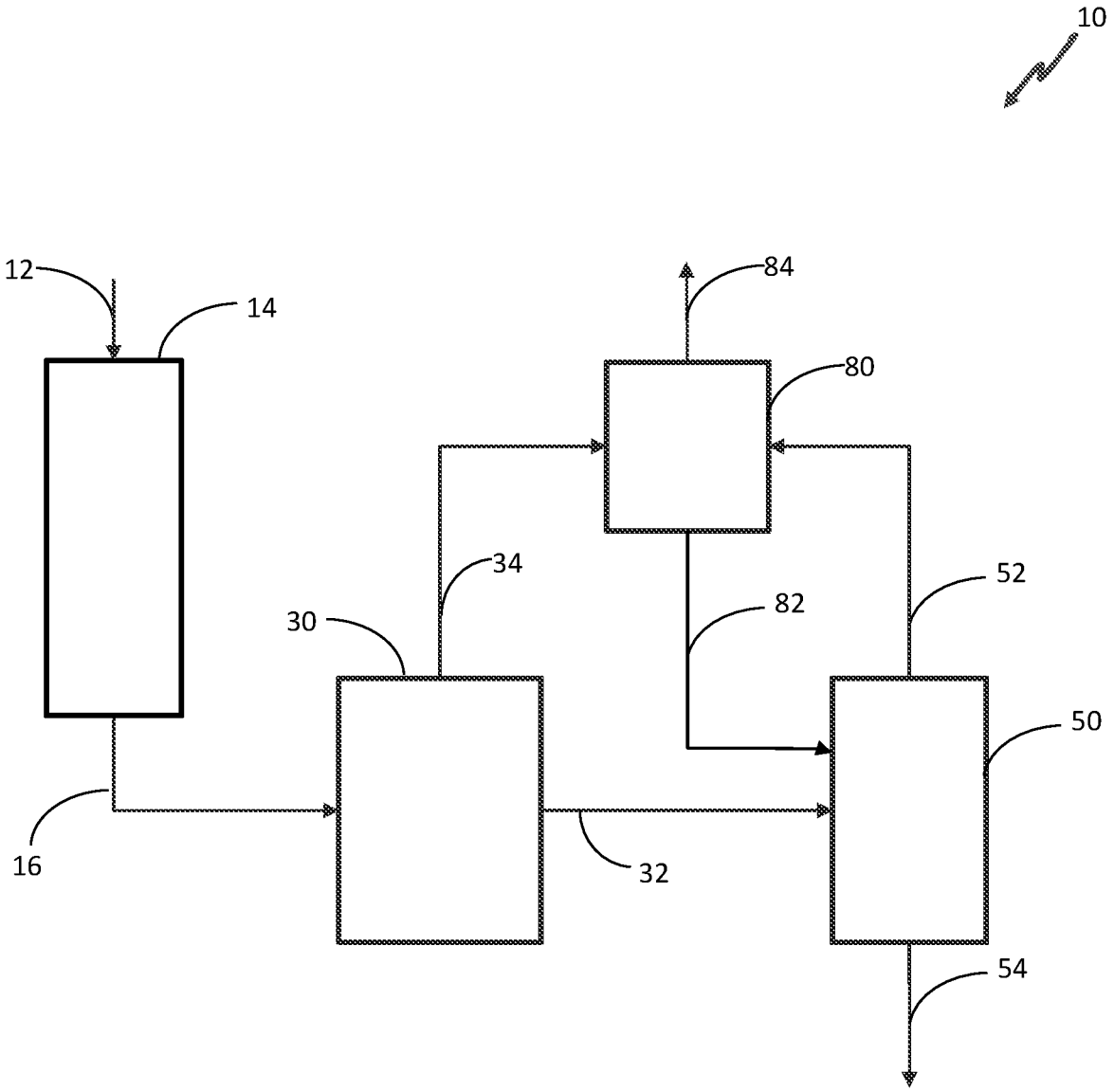
FIG. 1 is a schematic illustrating one embodiment of a process of the present invention.

The present invention provides a process for improving the yield of kerosene in the hydroprocessing of material from renewable sources.

The process of the present invention is important for the energy transition and can improve the environment by producing low carbon energy and/or chemicals from renewable sources, and, in particular, from degradable waste sources, whilst improving the efficiency of the process.

In conventional processes for producing fuel from renewable feed, the effluent from the hydroprocessing section tends to have a higher concentration of heavy molecules. Therefore, in order to meet the boiling point specifications for a kerosene product, especially for aviation fuels, the distillation cut is necessarily narrow, thereby limiting the yield of kerosene from conventional processes. At the same time, lighter components produced in the processing of renewable feed tend to have low commercial value and/or declining markets (e.g., LPG).

The process of the present invention has a hydroprocessing section, a work-up section, and a gas-handling section. Gases from the hydroprocessing section and/or the work-up section are handled in the gas-handling section to obtain a pressurized gas stream and a hydrocarbon fraction that is liquid at a pressure in a range from 0.5 to 15 barg (0-1.5 MPaG) and a temperature in a range from 0 to 50° C. Preferably, the hydrocarbon fraction comprises C5+ hydrocarbons. The hydrocarbon fraction is recycled to the work-up section to provide lighter molecules to a product stream. By providing an increased concentration of lighter molecules to the product stream, a wider jet cut can be recovered from the process.

Several embodiments of process units for carrying out the method of the present invention are illustrated in the drawings. For ease of discussion, additional equipment and process steps that may be used in a process for producing kerosene from a renewable feedstock are not shown. The additional equipment and/or process steps may include, for example, without limitation, pre-treaters, heaters, chillers, air coolers, heat exchangers, mixing chambers, valves, pumps, compressors, condensers, quench streams, recycle streams, slip streams, purge streams, reflux streams, and the like.

FIG. 1 illustrates one embodiment of the process of the present invention 10. A renewable feedstock 12 is reacted in a hydroprocessing section 14 to produce a hydroprocessed effluent 16. Hydrogen may be combined with the renewable feedstock 12 stream before it is introduced the hydroprocessing section 14, co-fed with the renewable feedstock 12, or added to the hydroprocessing section 14 independently of the renewable feedstock 12. Hydrogen may be fresh and/or recycled from another unit in the process and/or produced in a HMU (not shown). In another embodiment, the hydrogen may be produced in-situ in the reactor or process, for example, without limitation, by water electrolysis. The water electrolysis process may be powered by renewable energy (such as solar photovoltaic, wind or hydroelectric power) to generate green hydrogen, nuclear energy or by non-renewable power from other sources (grey hydrogen).

As used herein, the terms "renewable feedstock", "renewable feed", and "material from renewable sources" mean a feedstock from a renewable source. A renewable source may be animal, vegetable, microbial, and/or bio-derived or mineral-derived waste materials suitable for the production of fuels, fuel components and/or chemical feedstocks.

A preferred class of renewable materials are bio-renewable fats and oils comprising triglycerides, diglycerides, monoglycerides, free fatty acids, and/or fatty acid esters derived from bio-renewable fats and oils. Examples of fatty acid esters include, but are not limited to, fatty acid methyl esters and fatty acid ethyl esters. The bio-renewable fats and oils include both edible and non-edible fats and oils. Examples of bio-renewable fats and oils include, without limitation, algal oil, brown grease, canola oil, carinata oil, castor oil, coconut oil, colza oil, corn oil, cottonseed oil, fish oil, hempseed oil, jatropha oil, lard, linseed oil, milk fats, mustard oil, olive oil, palm oil, peanut oil, rapeseed oil, pongamia oil, sewage sludge, soy oils, soybean oil, sunflower oil, tall oil, tallow, used cooking oil, yellow grease, white grease, and combinations thereof.

Another preferred class of renewable materials are liquids derived from biomass and waste liquefaction processes. Examples of such liquefaction processes include, but are not limited to, (hydro) pyrolysis, hydrothermal liquefaction, plastics liquefaction, and combinations thereof. Renewable materials derived from biomass and waste liquefaction processes may be used alone or in combination with bio-renewable fats and oils.

The renewable materials to be used as feedstock in the process of the present invention may contain impurities. Examples of such impurities include, but are not limited to, solids, iron, chloride, phosphorus, alkali metals, alkaline-earth metals, polyethylene and unsaponifiable compounds. If required, these impurities can be removed from the renewable feedstock before being introduced to the process of the present invention. Methods to remove these impurities are known to the person skilled in the art.

The process of the present invention is most particularly advantageous in the processing of feed streams comprising substantially 100% renewable feedstocks. However, in one embodiment of the present invention, renewable feedstock may be co-processed with petroleum-derived hydrocarbons. Petroleum-derived hydrocarbons include, without limitation, all fractions from petroleum crude oil, natural gas condensate, tar sands, shale oil, synthetic crude, and combinations thereof. The present invention is more particularly advantageous for a combined renewable and petroleum-derived feedstock comprising a renewable feed content in a range of from 30 to 99 wt. %.

In the hydroprocessing section 14, renewable feedstock 12 is reacted under hydroprocessing conditions sufficient to cause a reaction selected from hydrogenation, hydrotreating (including, without limitation, hydrodeoxygenation, hydrodenitrogenation, hydrodesulphurization, and hydrodemetallization), hydrocracking, selective cracking, hydroisomerization, and combinations thereof. The reactions are preferably catalytic reactions, but may include non-catalytic reactions, such as thermal processing and the like. The hydroprocessing section 14 may be a single-stage or multi-stage. The hydroprocessing section 14 may be comprised of a single reactor or multiple reactors. In the case of catalytic reactions, the hydroprocessing section 14 may be operated in a slurry, fluidized bed, and/or fixed bed operation. In the case of a fixed bed operation, each reactor may have a single catalyst bed or multiple catalyst beds. The hydroprocessing section 14 may be operated in a co-current flow, counter-current flow, or a combination thereof.

An example of a single-stage reaction is disclosed in van Heuzen et al. (U.S. Pat. No. 8,912,374, 16 Dec. 2014), wherein hydrogen and a renewable feedstock are reacted with a hydrogenation catalyst under hydrodeoxygenation conditions. The whole effluent from the hydrodeoxygenation reaction is contacted with a catalyst under hydroisomerization conditions. The single-stage reaction may be carried out in a single reactor vessel or in two or more reactor vessels. The process may be carried out in a single catalyst bed, for example, using a multi-functional catalyst. Alternatively, the process may be carried out in a stacked bed configuration, where a first catalyst composition is stacked on top of a second catalyst composition.

The catalyst may be the same, a mixture or different throughout the hydroprocessing section 14. The hydroprocessing section 14 may comprise a single catalyst bed or multiple catalyst beds. The catalyst may be the same throughout the single catalyst bed, optionally there is a mixture of catalysts, or different catalysts may be provided in two or more layers in the catalyst bed. In an embodiment of multiple catalyst beds, the catalyst may be same or different for each catalyst bed.

The hydrogenation components may be used in bulk metal form or the metals may be supported on a carrier. Suitable carriers include refractory oxides, molecular sieves, and combinations thereof. Examples of suitable refractory oxides include, without limitation, alumina, amorphous silica-alumina, titania, silica, and combinations thereof. Examples of suitable molecular sieves include, without limitation, zeolite Y, zeolite beta, ZSM-5, ZSM-12, ZSM-22, ZSM-23, ZSM-48, SAPO-11, SAPO-41, ferrierite, and combinations thereof.

The hydroprocessing catalyst may be any catalyst known in the art that is suitable for hydroprocessing. Catalyst metals are often in an oxide state when charged to a reactor and preferably activated by reducing or sulphiding the metal oxide. Preferably, the hydroprocessing catalyst comprises catalytically active metals of Group VIII and/or Group VIB, including, without limitation, Pd, Pt, Ni, Co, Mo, W, and combinations thereof. Hydroprocessing catalysts are generally more active in a sulphided form as compared to an oxide form of the catalyst. A sulphiding procedure is used to transform the catalyst from a calcined oxide state to an active sulphided state. Catalyst may be pre-sulphided or sulphided in situ. Because renewable feedstocks generally have a low sulphur content, a sulphiding agent is often added to the feed to maintain the catalyst in a sulphided form.

Preferably, the hydrotreating catalyst comprises sulphided catalytically active metals. Examples of suitable catalytically active metals include, without limitation, sulphided nickel, sulphided cobalt, sulphided molybdenum, sulphided tungsten, sulphided CoMo, sulphided NiMo, sulphided MoW, sulphided NiW, and combinations thereof. A catalyst bed/zone may have a mixture of two types of catalysts and/or successive beds/zones, including stacked beds, and may have the same or different catalysts and/or catalyst mixtures. In case of such sulphided hydrotreating catalyst, a sulphur source will typically be supplied to the catalyst to keep the catalyst in sulphided form during the hydroprocessing step.

The hydrotreating catalyst may be sulphided in-situ or ex-situ. In-situ sulphiding may be achieved by supplying a sulphur source, usually $H_2S$ or an $H_2S$ precursor (i.e. a compound that easily decomposes into $H_2S$ such as, for example, dimethyl disulphide, di-tert-nonyl polysulphide or di-tert-butyl polysulphide) to the hydroprocessing catalyst during operation of the process. The sulphur source may be supplied with the feed, the hydrogen stream, or separately. An alternative suitable sulphur source is a sulphur-comprising hydrocarbon stream boiling in the diesel or kerosene boiling range that is co-fed with the feedstock. In addition, added sulphur compounds in feed facilitate the control of catalyst stability and may reduce hydrogen consumption.

Preferably, the hydroprocessing reactions include a hydroisomerization reaction to increase branching, thereby reducing the freezing point of the fuel.

The hydroprocessed effluent 16 is directed to a separation system 30 to produce at least one hydroprocessed liquid stream 32 and at least one separation system offgas stream 34.

The separation system 30 has one or more separation units including, for example, without limitation, gas/liquid separators, including hot high- and low-pressure separators, intermediate high- and low-pressure separators, cold high- and low-pressure separators, strippers, integrated strippers and combinations thereof. Integrated strippers include strippers that are integrated with hot high- and low-pressure separators, intermediate high- and low-pressure separators, cold high- and low-pressure separators. It will be understood by those skilled in the art that high-pressure separators operate at a pressure that is close to the hydroprocessing section 14 pressure, suitably 0-10 bar (0-1 MPa) below the reactor outlet pressure, while a low-pressure separator is operated at a pressure that is lower than a preceding reactor in the hydroprocessing section 14 pressure or a preceding high-pressure separator, suitably 0-15 barg (0-1.5 MPaG). Similarly, it will be understood by those skilled in the art that hot means that the hot-separator is operated at a temperature that is close to a preceding reactor in the hydroprocessing section 14 temperature, suitably sufficiently above water dew point (e.g., ≥20° C., preferably ≥10° C., above the water dew point) and sufficiently greater than salt deposition temperatures (e.g., ≥20° C., preferably ≥10° C., above the salt deposition temperature), while intermediate- and cold-separators are at a reduced temperature relative to the preceding reactor in the hydroprocessing section 14. For example, a cold-separator is suitably at a temperature that can be achieved via an air cooler. An intermediate temperature will be understood to mean any temperature between the temperature of a hot- or cold-separator.

In addition, the separation system 30 may include one or more treating units including, for example, without limitation, a membrane separation unit, an amine scrubber, a pressure swing adsorption (PSA) unit, a caustic wash, and combinations thereof. The treating units are preferably selected to separate desired gas phase molecules. For example, an amine scrubber is used to selectively separate $H_2S$ and/or carbon oxides from $H_2$ and/or hydrocarbons. As another example, a PSA unit may be used to purify a hydrogen stream for recycling to a stripper and/or a reactor in the hydroprocessing section 14.

The separation system 30 is simplified in the drawings for ease of discussion. It will be understood by those skilled in the art that the same or different separation units and/or the treating units may be provided between and/or after catalyst zones in the hydroprocessing section 14 and between and/or after components of the work-up section 50 and the gas-handling section 80.

The hydroprocessed liquid stream 32 is directed to a work-up section 50. The work-up section 50 has a product stripper and a product recovery unit.

In the product stripper, entrained and/or dissolved gases are stripped from the hydroprocessed liquid stream 32 to produce a stripper offgas stream 52 and a stripped liquid product stream.

The product stripper can be operated in a low-pressure mode or a high-pressure mode. In a low-pressure mode, the pressure is preferably in a range of from 2 to 10 bara (0.2 to 1.0 MPaA), more preferably from 3 to 7 bara (0.3 to 0.7 MPa). In a high-pressure mode, the pressure is preferably in a range of from 10 to 20 bara (1 to 2 MPa), more preferably from 12 to 15 bara (1.2 to 1.5 MPa). The selected pressure will influence the degree to which entrained and/or dissolved gases are removed from the hydroprocessed liquid stream 32, as well as the composition of the stripper offgas stream 52.

The stripper gas used for the product stripper may be, for example, without limitation, steam, hydrogen, and combinations thereof. In conventional processes, the stripper offgas stream 52 comprising the stripper gas and entrained and/or dissolved gases is used a fuel gas for furnaces in the process or other users at the refinery complex.

The stripper offgas stream 52 and/or one or more separation system offgas stream 34 is directed to a gas-handling section 80. Gas streams in the gas-handling section 80 are preferably subjected to pressurizing and/or cooling operations to obtain a pressurized gas stream 84 and a hydrocarbon fraction 82 that is liquid at 0.5-15 barg (0-1.5 MPaG) and 0-50° C. Preferably, the hydrocarbon fraction 82 comprises C5+ hydrocarbons. Examples of suitable equipment for the gas-handling section 80 include, without limitation, compressors, condensers, ejectors, knock-out drums, driers, turbines, and combinations thereof. Preferably, the gas-handling section is comprised of multiple compressor stages, preferably 2 or 3 compressor stages, with intermediate cooling and/or knock-out drums. The hydrocarbon fraction 82 preferably comprises all or a portion of the liquid from the knock-out drums.

The hydrocarbon fraction 82 from the gas-handling section 80 is recycled to the work-up section 50. The hydrocarbon fraction 82 may be recycled to the feed of the product stripper, introduced to stripped liquid product stream, introduced to the product recovery unit, and/or recycled to the kerosene product stream from the product recovery unit. As noted above, stream 82 is the hydrocarbon fraction that is liquid 72 at 0.5-15 barg (0-1.5 MPaG) and 0-50° C. The selection of pressure for the hydrocarbon fraction 82 is, for example, dependent on where the stream is being recycled.

A kerosene stream 54 is separated in the product recovery unit of the work-up section 50. The product recovery unit may be, for example, without limitation, a vacuum column, a vacuum drier, and/or an atmospheric fractionation column. In addition to the kerosene stream 54, the product recovery unit preferably also separates a higher boiling point stream and/or a lower boiling point stream. Examples of higher boiling point products include, without limitation, diesel, light gasoil, heavy gasoil, and vacuum gasoil. Examples of lower boiling point products include, without limitation, butanes and lighter, light naphtha and heavy naphtha.

The kerosene product produced by the method of the present invention is advantageously used as a fuel, alone or as a blending component. In a preferred embodiment, the kerosene product is used as a Synthesized Paraffinic Kerosene (SPK) blending component to meet or exceed the requirements specified in ASTM D7566.

Amongst other properties relating to freezing point, thermal stability, cycloparaffin content, metal content, and the like, ASTM D7566-20c requirements for SPK from hydroprocessed hydrocarbons, esters and fatty acids, include certain distillation temperatures as provided in Table I:

TABLE I

| Physical Distillation | | HC-HEFA SPK | Test Method |
|---|---|---|---|
| 10% recovered, temperature (T10) | Max | 205° C. | D86 or IP 123 or D7344 or D7345 |
| Final boiling point, temperature | Max | 300° C. | |
| T90-T10 | Min | 22° C. | |

A challenge with using renewable feedstocks for SPK is that the hydrocarbons produced from hydroprocessing are often larger chains than those produced from conventional mineral sources, with most molecules concentrating towards the final boiling point range (<300° C.). The method of the present invention increases the amount of kerosene make by increasing <205° C. boiling components, also enabling to add more <300° C. boiling point components to the distillation cut, thereby increasing the kerosene make of the process as a whole.

Figure 2A:
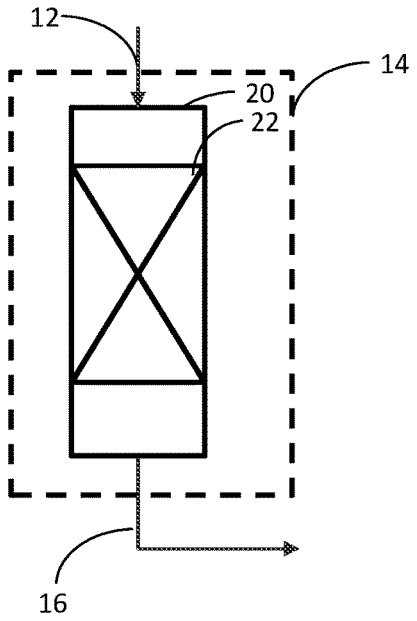
FIGS. 2A-2C illustrate embodiments of a single-stage hydroprocessing section for use in the process of the present invention.
Figure 2B:
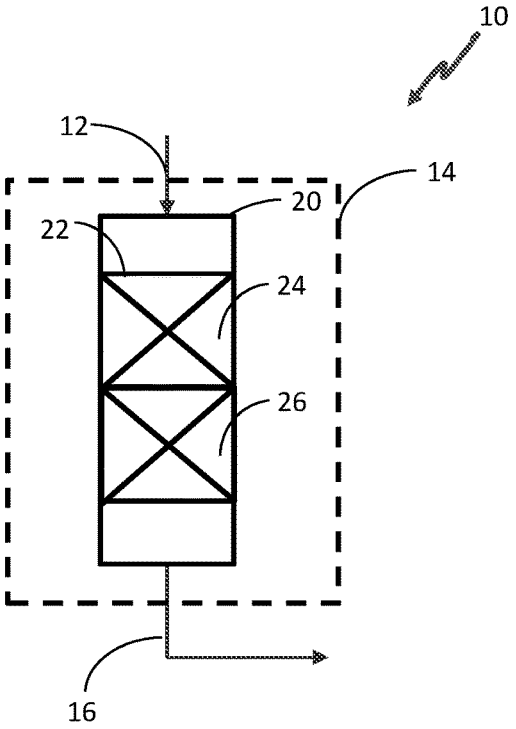
Figure 2C:
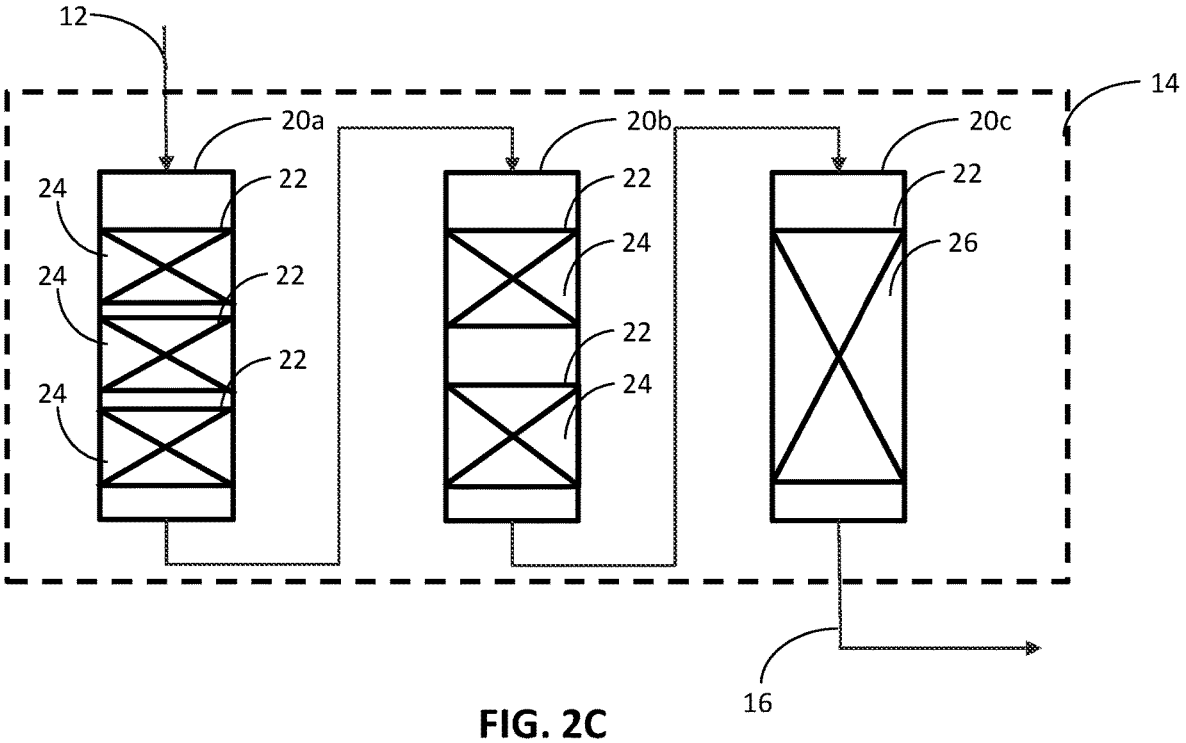

In one preferred embodiment, the hydroprocessing section 14 is operated as a single-stage process, in a co-current mode with one or more fixed beds. FIGS. 2A-2C illustrate single-stage embodiments of the hydroprocessing section 14. In FIG. 2A, the hydroprocessing section 14 has a single hydroprocessing reactor 20 having one or more catalyst beds 22 having the same multi-functional catalyst composition for catalysing at least one hydrotreating reaction, preferably hydrodeoxygenation, and a hydroisomerization reaction. In FIG. 2B, the hydroprocessing section 14 has a single hydroprocessing reactor 20 with a first catalyst composition 24, having a hydrotreating function, stacked on top of a second catalyst composition 26, having an isomerization function. In another embodiment, the hydroprocessing section 14 has two or more hydroprocessing reactors 20, for at least two catalyst compositions. For example, in the embodiment of FIG. 2C, the hydroprocessing section 14 has three hydroprocessing reactors 20*a*, 20*b*, 20*c* each having one or more catalyst beds 22. In the illustrated embodiment, reactors 20*a*, 20*b* have the same hydrotreating catalyst composition 24. Reactor 20*c* has one or more catalyst beds having an isomerization catalyst composition 26. In another embodiment, the isomerization catalyst 26 may also include a selective cracking function. Alternatively, a selective cracking catalyst may be provided in the same or different bed. The number of catalyst beds 22 in hydroprocessing reactors 20*a*, 20*b* and 20*c* are provided for illustrative purposes only. Different numbers of catalyst beds 22 may be used in each hydroprocessing reactor 20*a*, 20*b*, and/or 20*c*.

The hydroprocessed effluent 16 is then directed to a separation system 30 and a work-up section 50, which are not illustrated in FIGS. 2A-2C for emphasis on the single-stage embodiments of the hydroprocessing section 14.

Figure 3A:
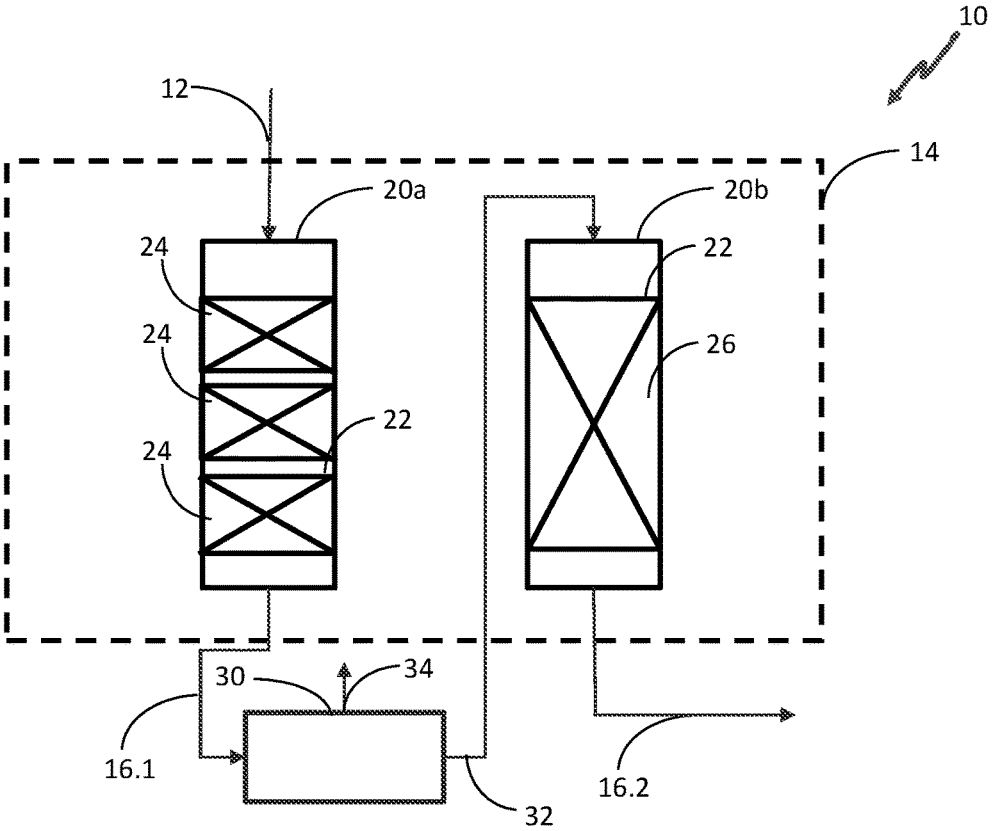
FIGS. 3A and 3B illustrate embodiments of a multi-stage hydroprocessing section for use in the process of the present invention.
Figure 3B:
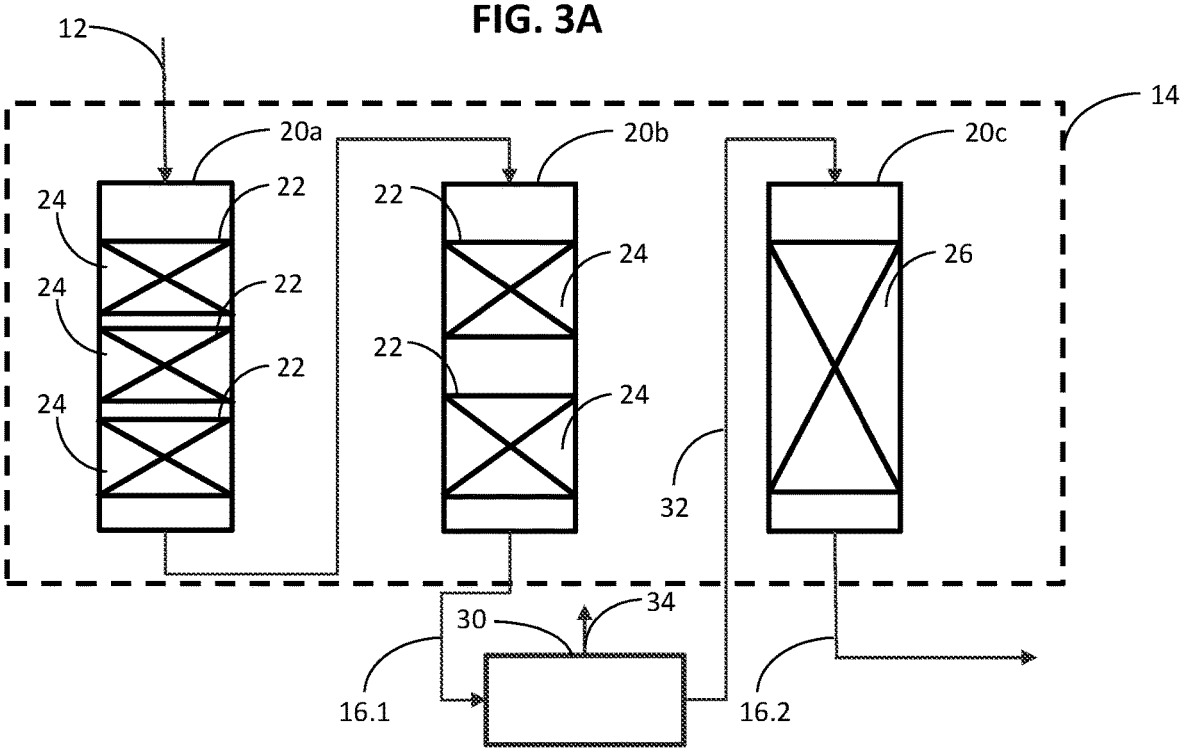

In another preferred embodiment, the hydroprocessing section 14 is operated as a multi-stage process, in a co-current mode with one or more fixed beds. FIGS. 3A and 3B illustrate multi-stage embodiments of the hydroprocessing section 14.

In FIG. 3A, the hydroprocessing section 14 has two hydroprocessing reactors 20*a*, 20*b*. In the embodiment of FIG. 3B, hydroprocessing reactors 20*a*, 20*b* operate as a single-stage, while reactors 20*b* and 20*c* operate in a multi-stage configuration with an intervening separation system 30. Alternatively, reactors 20*a*, 20*b* may operate in a multi-stage configuration with an intervening separation system, which may share some or all of the separator units of the separation system 30 between reactors 20*b*, 20*c*.

As shown, hydroprocessing reactor 20*a* has three catalyst beds 22 and hydroprocessing reactor 20*c* has one catalyst bed 22. In the embodiment of FIG. 3A, reactor 20*b* has one catalyst bed 22, while FIG. 3B shows two catalyst beds 22. The number of catalyst beds 22 are provided for illustrative purposes only and each reactor 20*a*, 20*b*, 20*c* may have the same or different number of catalyst beds 22. The type of catalyst used in each hydroprocessing reactor 20*a*, 20*b*, 20*c* may be the same or different. In a preferred embodiment, the catalyst in catalyst bed 22 of reactor 20*a* and reactor 20*b* of FIG. 3B is a hydrotreating catalyst 24 and the catalyst in catalyst bed 22 of reactor 20*b* of FIG. 3A and reactor 20*c* of FIG. 3B is a hydroisomerization catalyst 26.

In FIG. 3A, a separation system 30 is provided between the hydroprocessing reactors 20*a* and 20*b*. In FIG. 3B, a separation system 30 is provided between the hydroprocessing reactors 20*b* and 20*c*. The hydroprocessed effluent 16.1 is separated in the separation system 30 to produce one or more hydroprocessed liquid stream 32 and one or more separation system offgas stream 34. As illustrated, all or a portion of the hydroprocessed liquid stream 32 is directed to hydroprocessing reactor 20*c*.

A portion of the hydroprocessed effluent 16 and the hydroprocessed liquid stream 32 from one or more separator units may be returned to the hydroprocessing reactor 20*a*, for example, as a quench stream (not shown) or as a diluent (not shown) of feedstock 12. The hydroprocessed effluent 16.2 from hydroprocessing reactor 20*b*, 20*c* may be directed to one or more separation units of separation system 30 or to a different separator (not shown for ease of discussion) before being directed to the work-up section 50 (not shown for ease of discussion).

Figure 4A:
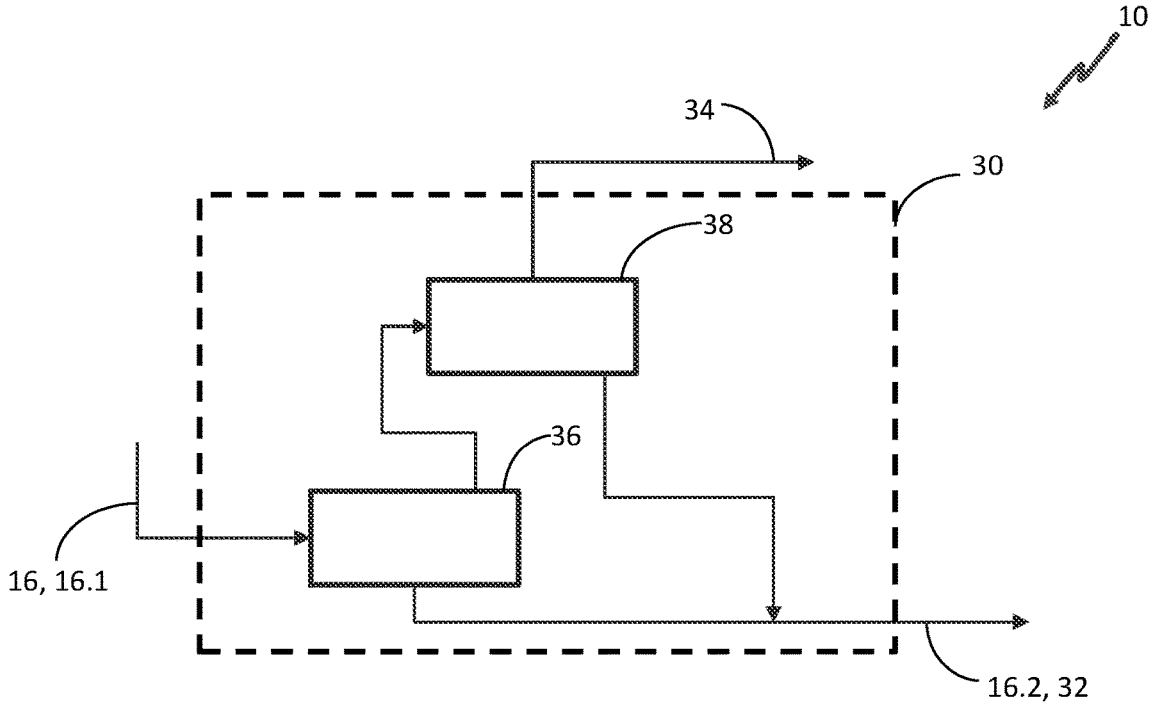
FIGS. 4A-4C illustrate embodiments of a separation system for use in the process of the present invention.
Figure 4B:
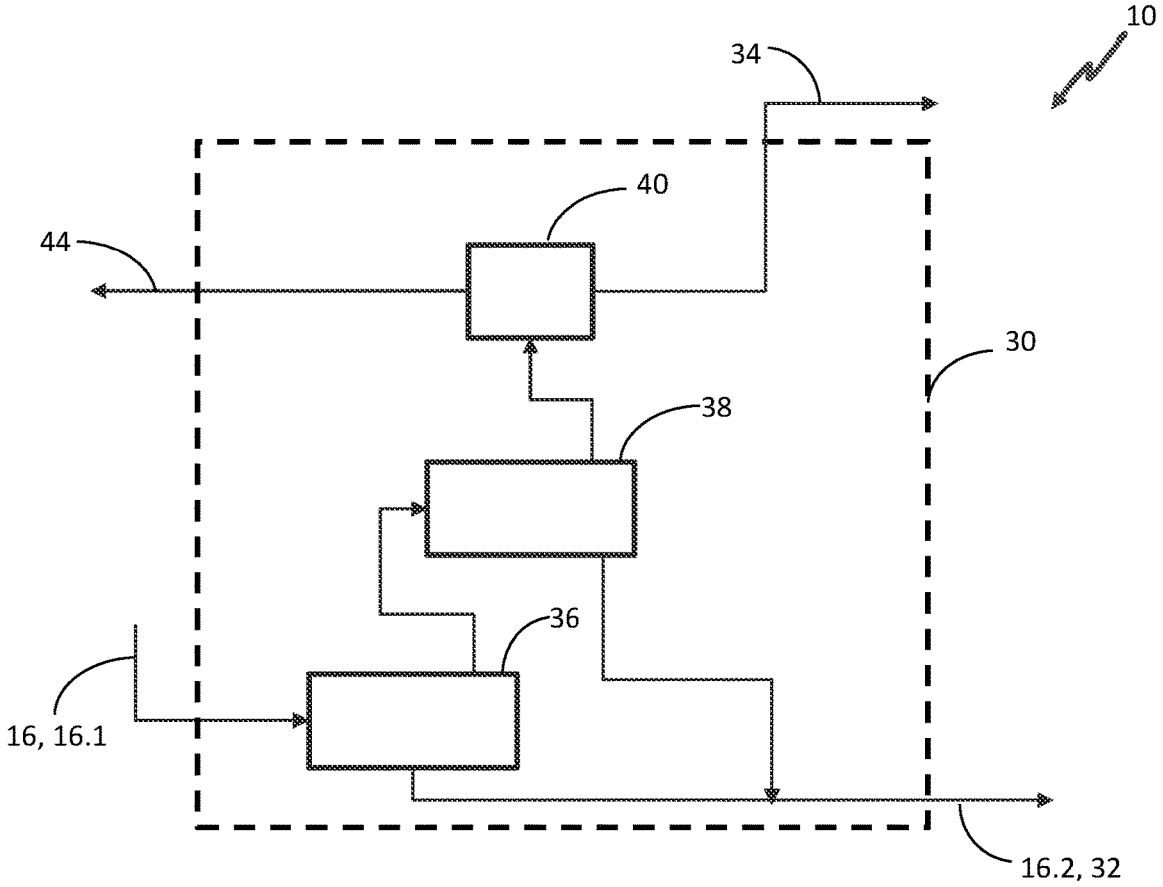
Figure 4C:
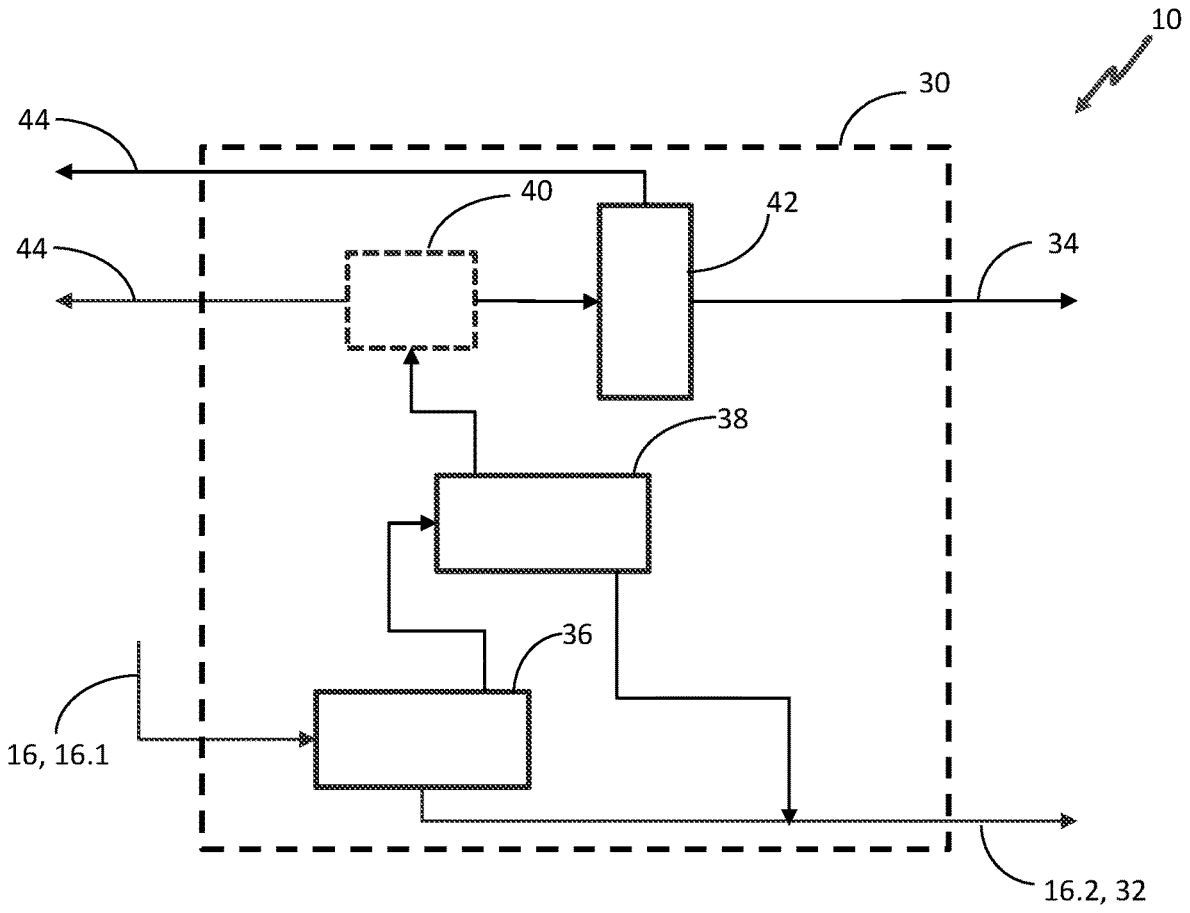

As noted above with respect to FIG. 1, the hydroprocessed effluent 16 is directed to a separation system 30 to produce at least one hydroprocessed liquid stream 32 and at least one separation system offgas stream 34. FIGS. 4A-4C illustrate preferred embodiments of the separation system 30. Pumps, valves, heat exchangers and other desired/required unit operations known to those skilled in the art are not illustrated for ease of discussion.

Hydroprocessed effluent 16, 16.1, 16.2 may each be treated in a separate embodiment of the separation system 30. In a preferred embodiment, hydroprocessed effluent 16, 16.1, 16.2 may be treated in all or some of the same separation units.

In the embodiment shown in FIG. 4A, the separation system 30 includes a hot separator (HS) 36, such as a hot high-pressure separator, a hot low-pressure separator, and/or an integrated stripper separator, and a cold separator (CS) 38, such as a cold high-pressure separator and/or a cold low-pressure separator. The HS 36 flashes off hydrogen-rich gases, in addition to light hydrocarbons, $CO_2$, carbon monoxide and $H_2S$, from hydroprocessed effluent 16, 16.1, resulting in a hydroprocessed liquid stream 32 and/or an interstage liquid stream. An interstage liquid stream is directed in whole or in part to a subsequent hydroprocessing zone and/or reactor. All or a portion of the hydroprocessed liquid stream 32 is directed to the work-up section 50. The HS 36 offgas is then cooled, for example in an air cooler (not shown) or a heat exchanger (not shown), and directed to the CS 38, where at least a portion of the light hydrocarbons are separated from the HS offgas stream as a liquid effluent stream, preferably combined with the effluent 16.2 and/or the hydroprocessed liquid stream 32. The offgas stream 34 may be directed to the gas-handling section 80 to a gas treating unit, not shown, or used for another purpose.

A portion of the liquid effluent from the HS 36 and/or the CS 38 may be recycled and/or used as a diluent and/or a quench stream between catalyst beds in one or more reactor in the hydroprocessing section 14. For example, by recycling from the HS 36, the operating costs from pumping and/or heating can be reduced.

In the embodiment illustrated in FIG. 4B, the separation system 30 includes a HS 36, a CS 38, and a PSA unit 40. All or a portion of the offgas stream from the CS 38 is directed to the PSA unit 40 to separate a hydrogen-enriched stream 44 from the CS offgas stream. The hydrogen-enriched stream 44 may be recycled to one or more reactors in the hydroprocessing section 14, a stripper in the separation system 30 or work-up section 50, and/or another processing unit in the refinery. The hydrogen-enriched stream 44 may be compressed in compressor (not shown) prior to recycle. The offgas stream 34 may also include a portion of the offgas from the HS 36 and/or CS 38. The offgas stream 34 may be directed to the gas-handling section 80, not shown, to another gas treating unit, not shown, or used for another purpose.

In the embodiment illustrated in FIG. 4C, the separation system 30 includes a HS 36, a CS 38, and an amine scrubber 42. The offgas stream from the CS 38 is directed to the amine scrubber 42 to separate a hydrogen-enriched stream from the CS offgas stream.

Optionally, all or a portion of the offgas stream from the CS 38 is first directed to a PSA 40 and the tail gas therefrom is then directed to the amine scrubber 42. In this embodiment, the tail gas from the PSA is typically at a lower pressure than the pressure of the amine scrubber 42. Accordingly, it may be desirable to compress the PSA tail gas prior to directing the tail gas to the amine scrubber 42. Alternatively, the PSA tail gas may be directed as an offgas stream 34 for handling in the gas-handling section 80 before being directed to the amine scrubber 42.

The hydrogen-enriched stream 44 from the amine scrubber 42 and/or the PSA unit 40 may be recycled to one or more reactors in the hydroprocessing section 14, a stripper in the separation system 30 or work-up section 50, and/or another processing unit. The hydrogen-enriched stream may be compressed in compressor (not shown) prior to recycle.

The amine scrubber 42 may be a scrubber containing monoethanolamine (MEA), diethanolamine (DEA), methyldiethanolamine (MDEA), promoted MEA, DEA, and/or MDEA, activated MEA, DEA and/or MDEA, and combinations thereof for removal of carbon monoxide. The offgas stream 34 may also include a portion of the offgas from the HS 36 and/or CS 38. Preferably, the amine-rich stream from the amine scrubber 42 is regenerated in a low-pressure amine regenerator (not shown) and the off-gas from the amine generator overhead may be directed to the gas-handling section 80. The offgas stream 34 may be directed to the gas-handling section 80, not shown, to another gas treating unit, not shown, or used for another purpose.

The hydroprocessed liquid stream 32 is directed to a work-up section 50. The work-up section has a product stripper 56 and a product recovery unit 58.

In the product stripper 56, entrained and/or dissolved gases are stripped from the hydroprocessed liquid stream 32 to produce a stripper offgas stream 52 and a stripped liquid product stream. Stripping gases that may be used in the product stripper 56 for stripping the gases include, for example, without limitation, steam, hydrogen, methane, nitrogen, and combinations thereof. The stripper offgas stream 52 is directed to the gas-handling section 80. The stripped liquid stream is directed to the product recovery unit 58.

Figure 5A:
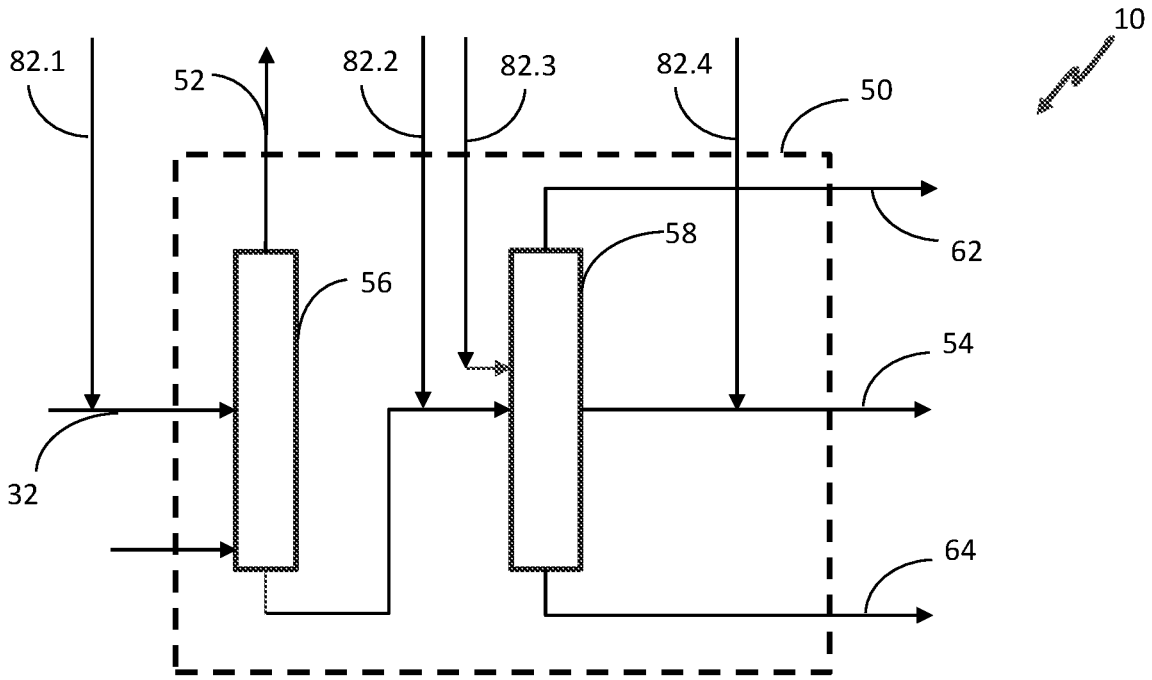
FIGS. 5A-5D illustrate embodiments of a work-up section for use in the process of the present invention.

In the embodiment of FIG. 5A, the stripped liquid includes naphtha boiling point range and higher boiling point range products. The stripped liquid stream is fractionated in the product recovery unit 58 into a kerosene product stream 54, a lower boiling point stream 62, e.g., naphtha, and a higher boiling point stream 64, e.g., diesel.

Figure 5B:
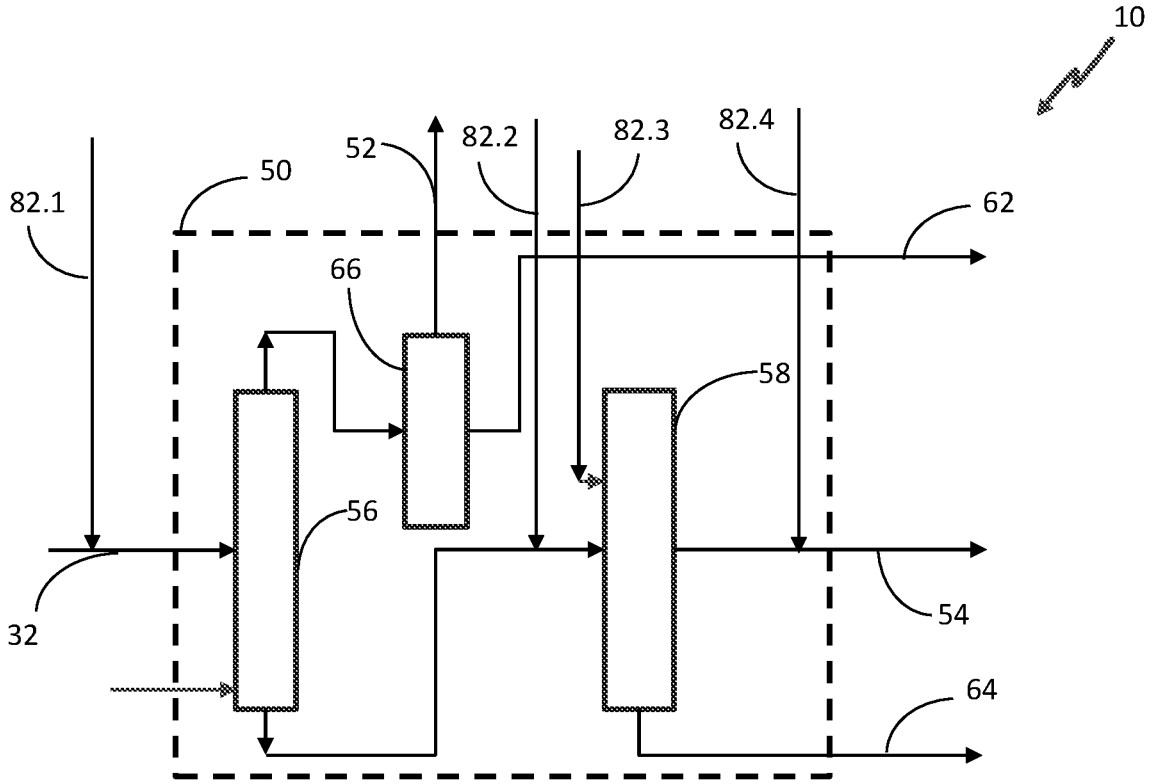

In the embodiment of FIG. 5B, the naphtha and lower boiling point range products are removed in an overhead stream of the product stripper 56. The stripped liquid stream is fractionated into a kerosene product stream 54 and a higher boiling point stream 64, e.g., diesel. The overhead stream from the product stripper 56 is directed to a naphtha stripper 66 to produce the stripper offgas stream 52 and a naphtha stream 62.

Figure 5C:
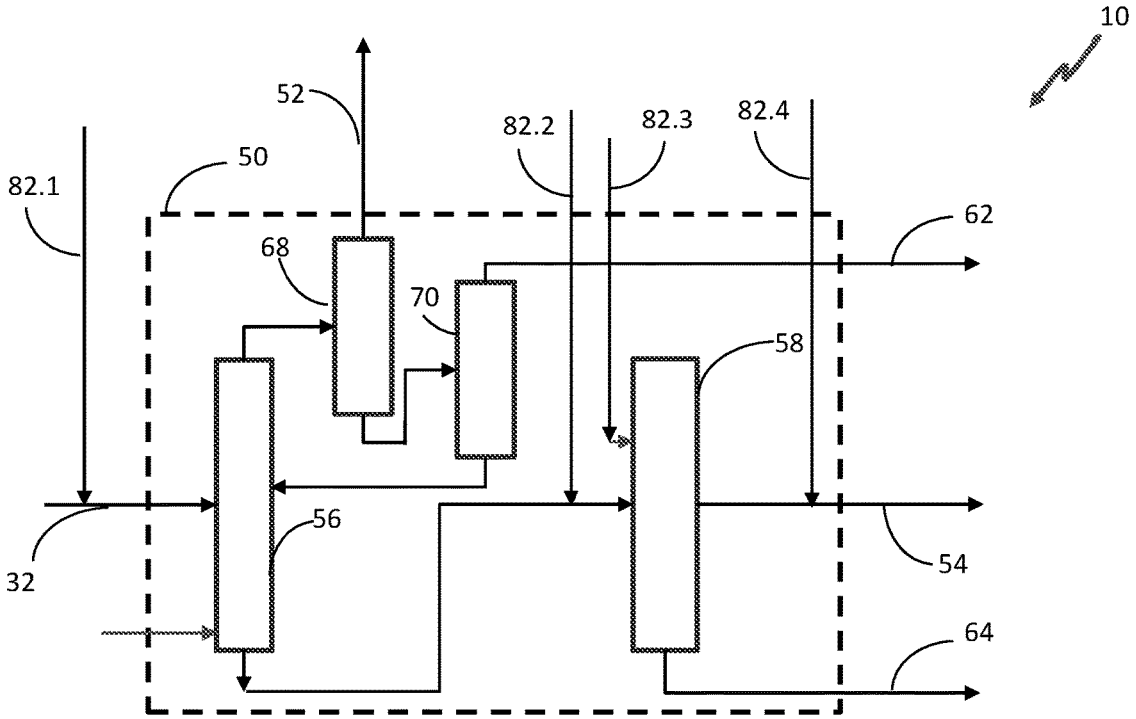

In the embodiment of FIG. 5C, the naphtha and lower boiling point range products are removed in an overhead stream of the product stripper 56. The stripped liquid stream is fractionated into a kerosene product stream 54 and a higher boiling point stream 64, e.g., diesel. The overhead stream from the product stripper 56 is directed to a naphtha stabilizer column 68 to produce a stripper offgas stream 52 and a stabilized naphtha stream that is passed to a naphtha rectification column 70 to produce a naphtha stream 62 and a heavy bottoms stream that is recycled to the product stripper 56.

Figure 5D:
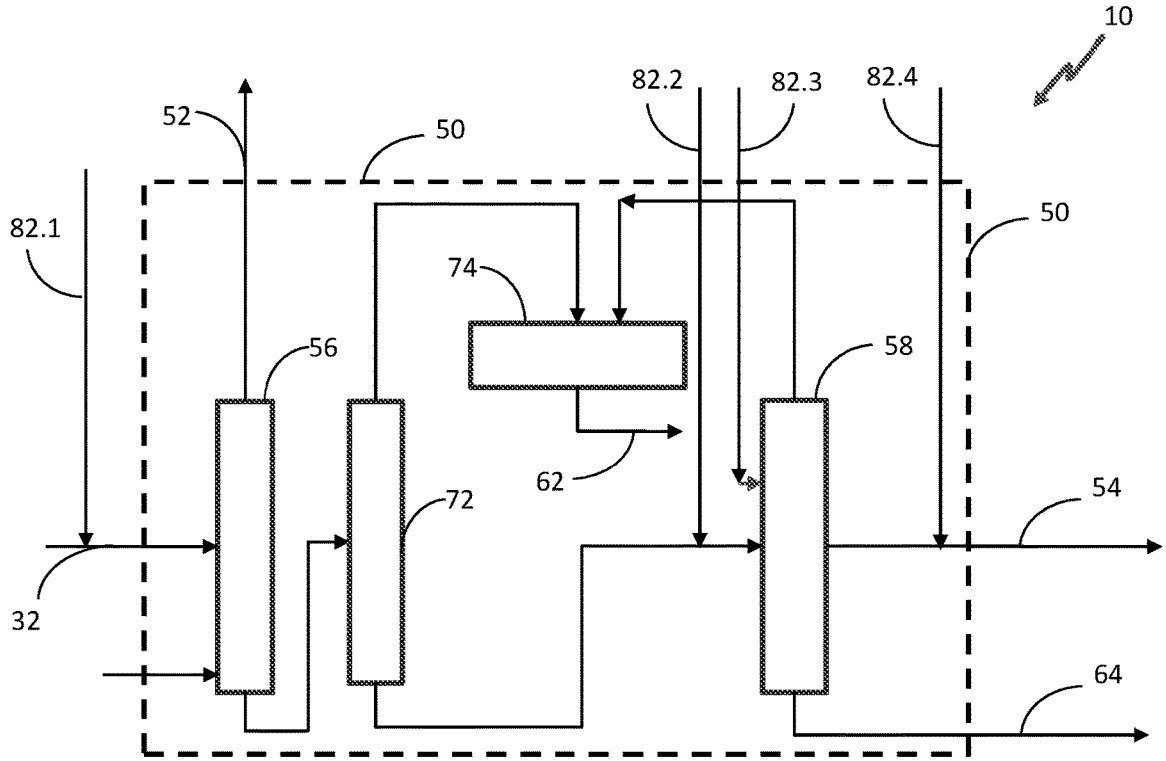

In the embodiment of FIG. 5D, the stripped liquid includes naphtha boiling point range and higher boiling point range products. The stripped liquid stream is directed to a naphtha recovery column 72. The bottoms stream from the naphtha recovery column 72 is directed to a vacuum fractionator 58 for fractionation into a kerosene product stream 54, a higher boiling stream 64, e.g., diesel. The overhead stream from the naphtha recovery column 72 is directed to an overhead separator 74 to produce a naphtha stream 62.

The liquid stream 82 from the gas-handling section 80 is recycled to the work-up section 50. Embodiments for recycle include recycling the liquid stream 82.1 to the feed of the product stripper, introduced the liquid stream 82.2 to the stripped liquid product stream, introduced to the product recovery unit 82.3, and/or recycled to the kerosene product stream 82.4 from the product recovery unit 58.

The stripper offgas stream 52 and/or one or more separation system offgas stream 34 is directed to the gas-handling section 80. Gas streams in the gas-handling section 80 are preferably subjected to pressurizing and/or cooling operations to obtain a pressurized gas stream 84 and a hydrocarbon fraction 82. Examples of suitable equipment for the gas-handling section 80 include, without limitation, compressors, heat exchangers, ejectors, knock-out drums, driers, turbines, and combinations thereof.

The hydrocarbon fraction 82 from the gas-handling section 80 is recycled to the work-up section 50. The hydrocarbon fraction 82 may be recycled to the feed of the product stripper 56, introduced to stripped liquid product stream, introduced to the product recovery unit 58, and/or recycled to the kerosene product stream from the product recovery unit 58.

EXAMPLES

The following non-limiting examples of embodiments of the process of the present invention as claimed herein are provided for illustrative purposes only.

Pilot plant data were used to calculate yields of kerosene stream for processes without and with recycle of the hydrocarbon fraction 82 from the gas-handling section 80, using a process engineering simulation software to provide mass and energy balances for a given process and operating conditions.

Figure 6:
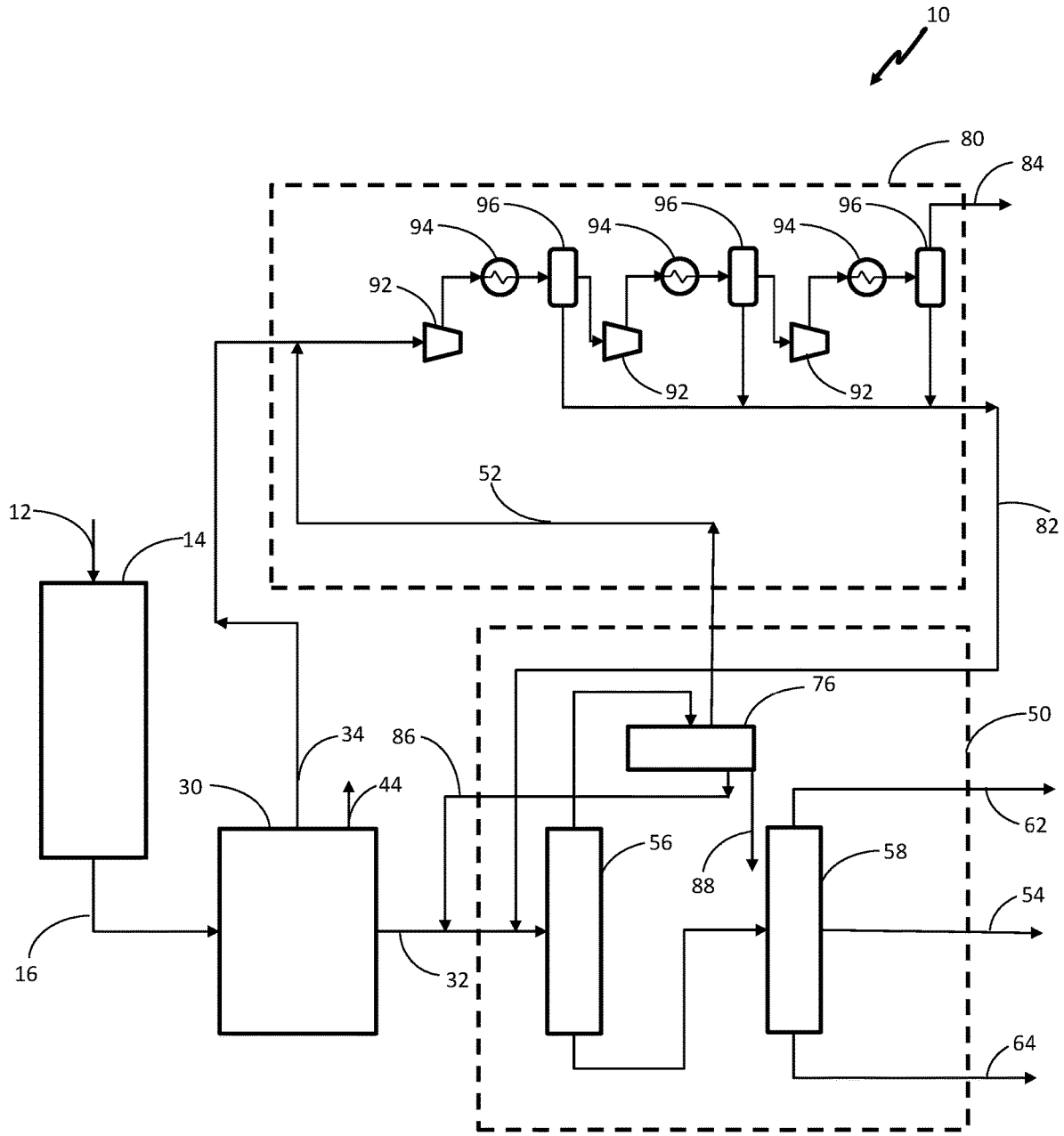
FIG. 6 illustrates a flow scheme used in simulation in an example of the process of the present invention.

The process scheme used for simulation is illustrated in FIG. 6. Two different feedstocks, namely tallow and used cooking oil (UCO), were used for the feed 12. The feed was subjected to hydrodeoxygenation and hydroisomerization in hydroprocessing section 14. The hydroprocessed effluent 16 was separated into a hydroprocessed liquid 32 and a separation system offgas stream 34.

The hydroprocessed liquid 32 was directed to a product stripper 56. The stripper overhead was directed to a cold low-pressure separator 76 and separated into a hydrocarbon liquid stream 86, a sour water stream 88 and a stripper off-gas stream 52. The stripper off-gas stream 52 was directed to three stages of compressor 92, heat exchanger 94 and knock-out drum 96.

For ease of discussion, pumps, valves, heat exchangers (other than those illustrated under reference numeral 94), knock-out drums (other than those illustrated under reference numeral 96), etc. not shown.

The results presented in Table II show kerosene yield produced in accordance with the present invention (Example 1 and 2) as compared to kerosene yield without using the present invention (Comp. Example 1 and 2). The feedstock for Example 1 and Comparative Example 1 was UCO, while the feedstock for Example 2 and Comparative Example 2 was tallow.

TABLE II

| PRODUCTS (Mass Balance) | Ex. 1 | Comp. Ex. 1 | Ex. 2 | Comp. Ex. 2 |
|---|---|---|---|---|
| Liquid stream from gas handling section recycled (stream 82) | 10.8 | — | 11.8 | — |
| Liquid stream from gas handling section to naphtha/fuel | — | 8.9 | — | 6.3 |
| Light Naphtha (stream 62) | 21.8 | 15.0 | 11.9 | 7.8 |
| Kerosene (stream 54) | 329.0 | 318.6 | 168.0 | 152.9 |
| Diesel (stream 64) | 145.7 | 154.1 | 309.7 | 322.7 |

As can be seen for both examples the invention results in an increased yield of kerosene (stream 54), and results in a reduced yield of liquid light components and diesel (stream 64). Furthermore, Examples 1 and 2 do not require export of the naphtha/fuel liquid stream that is required for Comparative Examples 1 and 2, thereby improving product value. The liquid light components are defined as the combined liquid stream from a) gas handling section to naphtha/fuel and b) light naphtha (stream 62).

While the embodiments are described with reference to various implementations and exploitations, it will be understood that these embodiments are illustrative and that the scope of the inventive subject matter is not limited to them. Many variations, modifications, additions and improvements are possible. Various combinations of the techniques provided herein may be used.

We claim:

1. A process for producing kerosene from a renewable feedstock, the process comprising the steps of:

reacting a renewable feedstock in a hydroprocessing section under hydroprocessing conditions sufficient to cause a hydroprocessing reaction to produce a hydroprocessed effluent;

separating the hydroprocessed effluent to produce at least one hydroprocessed liquid stream and at least one separation system offgas stream;

directing one or more of the at least one hydroprocessed liquid stream to a work-up section, comprising a product stripper and a product recovery unit;

stripping one or more of the at least one hydroprocessed liquid stream in the product stripper to remove gases from the one or more of the at least one hydroprocessed liquid stream to produce a stripped liquid product stream and a stripper offgas stream;

directing a gas stream comprising gases selected from the group consisting of one or more of the at least one separation system offgas stream, the stripper offgas stream, and combinations thereof, to a gas-handling section to obtain a pressurized gas stream and a hydrocarbon fraction that is liquid at a pressure in a range from 0.5 to 15 barg (0-1.5 MPaG) and a temperature in a range from 0 to 50° C.;

recycling the hydrocarbon fraction to the work-up section; and separating a kerosene stream from the stripped liquid product stream in the product recovery unit.

2. The process of claim 1, wherein the hydroprocessing reaction is selected from the group consisting of hydrogenation, hydrotreating, hydrocracking, hydroisomerization, selective cracking, and combinations thereof.

3. The process of claim 1, wherein the reacting step is comprised of at least two stages and wherein the step of separating the hydroprocessed effluent is conducted after each stage.

4. The process of claim 1, wherein the reacting step is a one stage step.

5. The process of claim 1, wherein the step of separating the hydroprocessed effluent comprises directing the effluent to one or more separator units, the separator unit selected from the group consisting of a hot high-pressure separator, a hot low-pressure separator, an intermediate high-pressure separator, an intermediate low-pressure separator, a cold high-pressure separator, a cold low-pressure separator, a stripper, an integrated stripper, and combinations thereof.

6. The process of claim 1, wherein the step of separating the hydroprocessed effluent further comprising a gas-treatment selected from the group consisting of membrane separation, amine adsorption, pressure swing adsorption, caustic wash, and combinations thereof.

7. The process of claim 3, wherein the step of separating the hydroprocessed effluent comprises directing the hydroprocessed effluent from each stage to the same or different separator units, the separator unit selected from the group consisting of a hot high-pressure separator, a hot low-pressure separator, an intermediate high-pressure separator, an intermediate low-pressure separator, a cold high-pressure separator, a cold low-pressure separator, a stripper, an integrated stripper, and combinations thereof.

8. The process of claim 1, wherein the kerosene separating step further comprises separating a higher boiling point stream, preferably a diesel stream.

9. The process of claim 1, wherein the kerosene separating step further comprises separating a lower boiling point stream, preferably a naphtha stream.

10. The process of claim 1, wherein the hydrocarbon fraction is recycled to the work-up section at a point selected from the group consisting of a feed of the product stripper, the stripped liquid product stream, a feed to the product recovery unit, the kerosene stream from the product recovery unit, and combinations thereof.

11. The process of claim 1, wherein the renewable feedstock is selected from the group consisting of one or more bio-renewable fats and oils, liquid derived from a biomass liquefaction process, liquid derived from a waste liquefaction process, and combinations thereof.

12. The process of claim 1, further comprising adding a petroleum-derived feedstock for co-processing with the renewable feedstock, preferably in an amount to produce a feed stream comprising from 30 to 99 wt. % renewable feedstock.

* * * * *